US012318828B2

(12) United States Patent
Kuramoto et al.

(10) Patent No.: US 12,318,828 B2
(45) Date of Patent: Jun. 3, 2025

(54) WIRE DRAWING DIE

(71) Applicants: A.L.M.T. Corp., Tokyo (JP); Sumitomo Electric Industries, Ltd., Osaka (JP)

(72) Inventors: Kohei Kuramoto, Osaka (JP); Takuya Kinoshita, Sumoto (JP); Yutaka Kobayashi, Osaka (JP); Makoto Yukawa, Kato (JP); Kohichiroh Kimura, Sumoto (JP); Kentaro Shiro, Kato (JP)

(73) Assignees: A.L.M.T. Corp., Tokyo (JP); Sumitomo Electric Industries, Ltd., Osaka (JP)

( * ) Notice: Subject to any disclaimer, the term of this patent is extended or adjusted under 35 U.S.C. 154(b) by 108 days.

(21) Appl. No.: 18/019,177

(22) PCT Filed: Aug. 11, 2021

(86) PCT No.: PCT/JP2021/029606
§ 371 (c)(1),
(2) Date: Feb. 1, 2023

(87) PCT Pub. No.: WO2022/044802
PCT Pub. Date: Mar. 3, 2022

(65) Prior Publication Data

US 2023/0321704 A1 Oct. 12, 2023

(30) Foreign Application Priority Data

Aug. 24, 2020 (JP) ..... 2020-140863

(51) Int. Cl.
*B21C 23/08* (2006.01)

(52) U.S. Cl.
CPC ..... *B21C 23/08* (2013.01)

(58) Field of Classification Search
CPC ..... B21C 23/02; B21C 23/04; B21C 23/08; B21C 3/02
See application file for complete search history.

(56) References Cited

U.S. PATENT DOCUMENTS 4,567,793 A * 2/1986 Millner ..... B21C 3/18 76/107.4
5,634,369 A * 6/1997 Anthony ..... B21C 3/025 72/467

(Continued)

FOREIGN PATENT DOCUMENTS

CN 202377289 U 8/2012
CN 203678890 U 7/2014

(Continued)

OTHER PUBLICATIONS

Communication issued in European Application No. 21861230.7 dated Jun. 20, 2024.

(Continued)

*Primary Examiner* — Teresa M Ekiert
(74) *Attorney, Agent, or Firm* — McCarter & English, LLP; Michael A. Sartori

(57) ABSTRACT

A wire drawing die 1 includes a non-diamond material, is provided with a die hole 1*h*, and has a reduction 1*c* and a bearing 1*d* that is positioned downstream of the reduction 1*c*. A reduction angle γ which is an opening angle of the die hole 1*h* at the reduction 1*c* is less than or equal to 17°, and a surface roughness Ra of the die hole 1*h* within ±20 μm from a specific position inside the bearing 1*d* in a circumferential direction of the die hole 1*h* that is perpendicular to a wire drawing direction is less than or equal to 0.025 μm.

7 Claims, 4 Drawing Sheets

(56) References Cited

U.S. PATENT DOCUMENTS

| | | | |
|---|---|---|---|
| 2015/0000207 | A1 | 1/2015 | Ishida et al. |
| 2017/0056946 | A1 | 3/2017 | Saito |
| 2019/0329308 | A1 | 10/2019 | Shindo et al. |
| 2020/0277187 | A1 | 9/2020 | Can et al. |

FOREIGN PATENT DOCUMENTS

| | | | |
|---|---|---|---|
| EP | 3536414 | A1 | 9/2019 |
| JP | S56-098405 | A | 8/1981 |
| JP | S58-41925 | A | 3/1983 |
| JP | H02-006011 | A | 1/1990 |
| JP | H02-127912 | A | 5/1990 |
| JP | H3-008518 | A | 1/1991 |
| JP | H04-147713 | A | 5/1992 |
| JP | 2007-090371 | A | 4/2007 |
| JP | 2014-034487 | A | 2/2014 |
| KR | 20200057044 | A | 5/2020 |
| WO | 2013/031681 | A1 | 3/2013 |
| WO | WO-2015/159675 | A1 | 10/2015 |
| WO | 2018-123513 | A1 | 7/2018 |

OTHER PUBLICATIONS

Office Action issued in Taiwan Application No. 11321334670 dated Dec. 30, 2024. [w/English Translation].
Decision to Grant JP Application No. 2022-545628 dated Jan. 28, 2025.

* cited by examiner

WIRE DRAWING DIE

TECHNICAL FIELD

The present disclosure relates to a wire drawing die. The present application claims priority based on Japanese Patent Application No. 2020-140863 filed on Aug. 24, 2020. All the contents described in the Japanese patent application are incorporated herein by reference.

BACKGROUND ART

Conventionally, wire drawing dies are disclosed in, for example, Japanese Patent Laying-Open No. H02-6011 (Patent Literature 1), Japanese Patent Laying-Open No. H02-127912 (Patent Literature 2), Japanese Patent Laying-Open No. H04-147713 (Patent Literature 3), International Publication No. 2013/031681 (Patent Literature 4), Japanese Patent Laying-Open No. 2014-34487 (Patent Literature 5), and Japanese Patent Laying-Open No. S56-98405 (Patent Literature 6).

CITATION LIST

Patent Literatures

PTL 1: Japanese Patent Laying-Open No. H02-6011
PTL 2: Japanese Patent Laying-Open No. H02-127912
PTL 3: Japanese Patent Laying-Open No. H04-147713
PTL 4: International Publication No. 2013/031681
PTL 5: Japanese Patent Laying-Open No. 2014-34487
PTL 6: Japanese Patent Laying-Open No. S56-98405

SUMMARY OF INVENTION

A wire drawing die according to the present disclosure includes a non-diamond material, is provided with a die hole, and has a reduction and a bearing positioned downstream of the reduction, in which a reduction angle which is an opening angle of the die hole at the reduction is less than or equal to 17°, and a surface roughness Ra of the die hole within ±20 μm from a specific position inside the bearing in a circumferential direction of the die hole that is perpendicular to a wire drawing direction is less than or equal to 0.025 μm.

DETAILED DESCRIPTION

Figure 1:
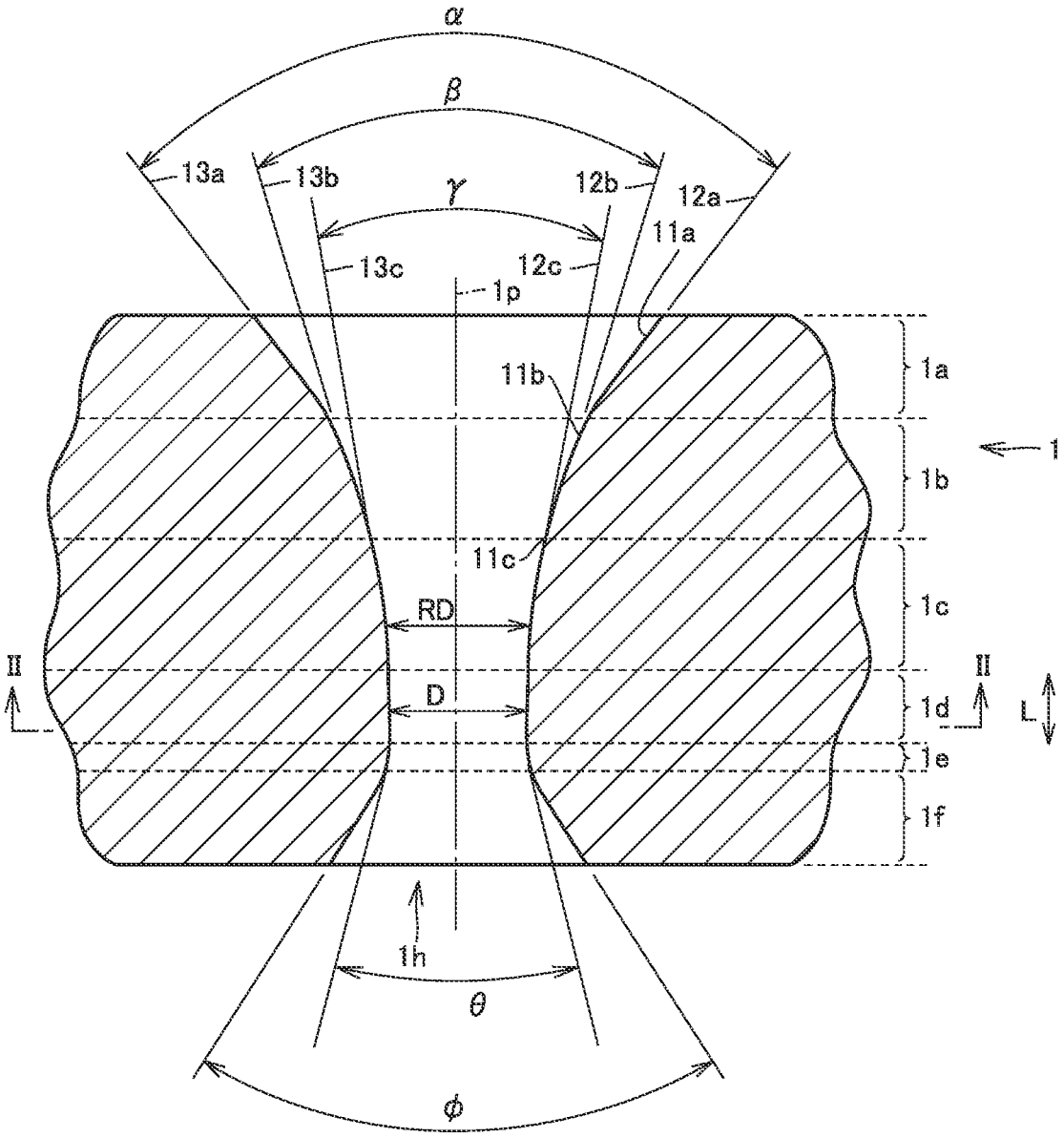
FIG. 1 is a cross-sectional diagram of a wire drawing die according to an embodiment.

Problem to be Solved by the Present Disclosure

A conventional wire drawing die is demanded to be improved in life.

Description of Embodiments

First, embodiments of the present disclosure will be listed and described.

A wire drawing die according to the present disclosure includes a non-diamond material, is provided with a die hole, and has a reduction and a bearing positioned downstream of the reduction, wherein a reduction angle which is an opening angle of the die hole at the reduction is less than or equal to 17°, and a surface roughness Ra of the die hole within ±20 μm (within 40 μm in total) from a specific position inside the bearing in a circumferential direction of the die hole that is perpendicular to a wire drawing direction is less than or equal to 0.025 μm.

Examples of the non-diamond material include CBN, or at least one nitride or carbide selected from the group consisting of titanium, silicon, aluminum, and chromium.

The CBN may be binderless CBN containing no binder or CBN containing a binder. The non-diamond material may be a mixture of CBN and compressed hBN (hexagonal boron nitride). Here, the "compressed hexagonal boron nitride" refers to hexagonal boron nitride having a crystal structure similar to that of normal hexagonal boron nitride, and having a lattice spacing in the c-axis direction smaller than that (0.333 nm) of normal hexagonal boron nitride.

The cross section of the die hole perpendicular to the wire drawing direction is generally circular. However, the cross section may be angular.

The wire drawing die has a bell, an approach, a reduction, a bearing, a back relief, and an exit in order from the upstream side.

A reduction angle, which is the opening angle of the die hole at the reduction, is less than or equal to 17°. In the cross-sectional diagram of the die hole parallel to the wire drawing direction, two first tangent lines are drawn on both lateral surfaces at a portion where a diameter RD of the reduction is 1.050 D, and an angle formed by the two first tangent lines is defined as a reduction angle. When the reduction angle exceeds 17°, the life of the wire drawing die is shortened. More preferably, the reduction angle is equal to or greater than 6° and equal to or less than 15°.

The surface roughness Ra of the die hole within ±20 μm from a specific position inside the bearing in a circumferential direction of the die hole that is perpendicular to the wire drawing direction is less than or equal to 0.025 μm. If the surface roughness exceeds 0.025 μm, the surface roughness of a wire is deteriorated and the life is shortened. Preferably, the surface roughness Ra is greater than or equal to 0.005 μm and less than or equal to 0.025 μm.

Preferably, the length of the bearing is less than or equal to 200% D where the diameter of the bearing is D. When the length of the bearing is greater than or equal to 200% D, the bearing increases in length, and it is likely that the life is decreased. Note that the wording "it is likely that" indicates that there is a slight possibility of such a situation, and does not mean that there is a high probability of such a situation.

Preferably, a reduction of area is greater than or equal to 5%. If the reduction of area exceeds 5%, it is likely that the bearing is worn. The reduction of area is obtained by (cross-sectional area of wire before wire drawing—cross-sectional area of wire after wire drawing)/(cross-sectional area of wire before wire drawing)×100.

Preferably, a base wire and the die are in initial contact with each other at the reduction, and the die and a wire are in contact with each other at a length greater than or equal to 50% D including the bearing. In this case, the wire can be more reliably processed by the bearing.

Preferably, the thermal conductivity of the wire drawing die is 100 to 300 W/(m·K). In this case, heat generated by friction between the wire and the wire drawing die can be easily dissipated to the outside.

Unless the shape standard of the CBN die is appropriately set, the life of the die is significantly shortened due to machine wear. CBN has a Knoop hardness of about 40-50 GPa which is only about half of that of diamond (70-130 GPa), and has a drawback of being disadvantageous for mechanical wear. Therefore, by setting the reduction shape or the like to an appropriate range, it is possible to prevent the surface pressure of the die from excessively increasing and to suppress mechanical wear.

The CBN die is more likely to have scratches on the inner surface of the die than the diamond die, and CBN affecting the wire quality after wire drawing has low hardness as described above, so that scratches are caused on the inner surface of the die when the inner surface is polished, and the wire quality after wire drawing is greatly affected.

The wire drawing die according to the present disclosure has a long life by addressing the above problems.

FIG. 1 is a cross-sectional diagram of a wire drawing die according to an embodiment. As illustrated in FIG. 1, a die 1 for wire drawing according to a first embodiment has a die hole 1*h*. Die 1 has a bell 1*a*, an approach 1*b*, a reduction 1*c*, a bearing 1*d*, a back relief 1*e*, and an exit 1*f* in order from the upstream side.

Bell 1*a* is located on the most upstream side of die hole 1*h*. An angle α formed by tangent lines 12*a* and 13*a* of the lateral surfaces of die hole 1*h* defining bell 1*a* is defined as a bell angle. Bell 1*a* corresponds to an inlet of a wire to be drawn and a lubricant.

Approach 1*b* is provided downstream of bell 1*a*. At the boundary between bell 1*a* and approach 1*b*, the inclination of die hole 1*h* may change continuously or discontinuously. An angle β formed by tangent lines 12*b* and 13*b* of the lateral surfaces of die hole 1*h* defining approach 1*b* is defined as an approach angle.

Reduction 1*c* is provided downstream of approach 1*b*. At the boundary between approach 1*b* and reduction 1*c*, the inclination of die hole 1*h* may change continuously or discontinuously. An angle γ of the lateral surfaces of die hole 1*h* defining reduction 1*c* is defined as a reduction angle.

Bearing 1*d* is provided downstream of reduction 1*c*. At the boundary between reduction 1*c* and bearing 1*d*, the inclination of die hole 1*h* may change continuously or discontinuously. A diameter D of die hole 1*h* defining bearing 1*d* is constant.

Bearing 1*d* has a cylindrical shape. Bearing 1*d* is a portion having the smallest diameter in die hole 1*h*.

Back relief 1*e* is provided downstream of bearing 1*d*. At the boundary between bearing 1*d* and back relief 1*e*, the inclination of die hole 1*h* may change continuously or discontinuously. An angle θ of the lateral surfaces of die hole 1*h* defining back relief 1*e* is defined as a back relief angle.

Exit 1*f* is provided downstream of back relief 1*e*. At the boundary between back relief 1*e* and exit 1*f*, the inclination of die hole 1*h* may change continuously or discontinuously. An angle φ of the lateral surfaces of die hole 1*h* defining exit 1*f* is defined as an exit angle.

When the diameter of reduction 1*c* is RD, a relationship of $D<RD\leq 1.050\ D$ is established between RD and D. Therefore, a portion having diameter RD satisfying the above relationship is reduction 1*c*. The cross-sectional area of reduction 1*c* is more than 100% and less than or equal to 110% of the cross-sectional area of bearing 1*d*.

The length of bearing 1*d* is L. A relationship of $0<L<200\%\ D$ is established between L and D.

In order to measure the shapes of bell 1*a*, approach 1*b*, reduction 1*c*, bearing 1*d*, back relief 1*e*, and exit 1*f*, die hole 1*h* is filled with a transfer material (for example, a replica set manufactured by Struers K.K.) to prepare a replica to which the shape of die hole 1*h* is transferred. This replica is cut along a plane including a center line 1*p* to obtain a cross-sectional diagram of a die hole 1*h* such as die hole 1*h* in FIG. 1. The shape of each portion can be measured based on this cross-sectional diagram. When bearing 1*d* has a sufficiently large diameter, the replica to which die hole 1*h* has been transferred can be pulled out from die hole 1*h* by elastically deforming the replica. In a case where bearing 1*d* has a small diameter and the replica cannot be pulled out from die hole 1*h* even if the replica is elastically deformed, the replica is cut in the vicinity of exit if and the shape of the portion other than exit if is reproduced using the replica. Further, die hole 1*h* is filled with the transfer material to create a replica, the created replica is cut near bell 1*a*, and the shape of the portion other than bell 1*a* is reproduced using the replica. By combining these, the cross section of die hole 1*h* can be obtained.

In measuring reduction angle γ, tangent lines 12*c* and 13*c* are drawn on both lateral surfaces at a reference point 11*c* (portion where RD=1.050 D) of reduction 1*c*, and an angle formed by two tangent lines 12*c* and 13*c* is defined as reduction angle γ in the cross-sectional diagram of die hole 1*h*.

Detailed Description of Embodiments

EXAMPLE 1

(Basic Evaluation of BL (Binderless) CBN Die for Wire Drawing)

In order to check the performance depending on the difference in die material, the following three types of dies having the same shape were prepared and evaluated.

Die Material

Three types of dies were prepared: A. single-crystal diamond die, B. binderless PCD die, and C. CBN die. The CBN die contains 99 mass % or more CBN and less than 1 mass % of hBN. This composition was measured by the following method. The contents (volume %) of cubic boron nitride, compressed hexagonal boron nitride, and wurtzite boron nitride in the CBN die can be measured by an X-ray diffraction method. A specific measurement method is as follows. The CBN die is cut with a diamond grindstone electrodeposition wire, and the cut surface is used as an observation surface.

The X-ray spectrum of the cut surface of the CBN die is obtained using an X-ray diffractometer ("MiniFlex600" (trade name) manufactured by Rigaku Corporation). The conditions of the X-ray diffractometer for the measurement are, for example, as follows.

Characteristic X-Ray: Cu-Kα (wavelength 0.154 nm)

Tube voltage: 45 kV

Tube current: 40 mA

Filter: Multilayer mirror

Optical system: concentration system

X-ray diffraction method: θ-2θ method

In the obtained X-ray spectrum, the following peak intensity A, peak intensity B, and peak intensity C are measured.

Peak intensity A: Peak intensity of the compressed hexagonal boron nitride excluding a background from the peak intensity near the diffraction angle 2θ=28.5° (peak intensity at the diffraction angle 2θ=28.5° of the X-ray spectrum)

Peak intensity B: Peak intensity of the wurtzite boron nitride excluding the background from the peak intensity near the diffraction angle 2θ=40.8° (peak intensity at the diffraction angle of 40.8° of the X-ray spectrum)

Peak intensity C: Peak intensity of the cubic boron nitride excluding a background from the peak intensity near the diffraction angle 2θ=43.5° (peak intensity at the diffraction angle 2θ=43.5° of the X-ray spectrum)

The content of the compressed hexagonal boron nitride is obtained by calculating the value of peak intensity A/(peak intensity A+peak intensity B+peak intensity C). The content of the wurtzite boron nitride is obtained by calculating a value of peak intensity B/(peak intensity A+peak intensity B+peak intensity C). The content of the cubic boron nitride polycrystal is obtained by calculating a value of peak intensity C/(peak intensity A+peak intensity B+peak intensity C). Compressed hexagonal boron nitride, wurtzite boron nitride, and cubic boron nitride all have the same electronic weight, and thus the X-ray peak intensity ratio can be regarded as a volume ratio in the CBN die. When each volume ratio is known, the mass ratio thereof can be calculated from the density of compressed hexagonal boron nitride (2.1 g/cm$^3$), the density of wurtzite boron nitride (3.48 g/cm$^3$), and the density of cubic boron nitride (3.45 g/cm$^3$).

The crystal grain size D50 of CBN is 200 to 300 μm. D50 refers to a diameter at which, when particles are divided into two in terms of particle diameter, the number of particles on the larger side and the number of particles on the smaller side are the same.

D50 was measured as follows. The CBN die is cut by wire electrical discharge machining, a diamond grindstone electrodeposition wire, or the like, and ion milling is performed on the cut surface. The measurement site on the CP processed surface is observed using SEM ("JSM-7500F" (trade name) manufactured by JEOL Ltd.) to obtain an SEM image. The size of the measurement field of view is 12 μm×15 μm, and the observation magnification is ×10,000. With the grain boundaries of the crystal grains observed in the measurement field of view being separated, the aspect ratio of each crystal grain, the area of each crystal grain, and the distribution of the equivalent circle diameter of the crystal grain are calculated using image processing software (Win Roof ver. 7.4.5). D50 is calculated using the result.

Die Shape: (Dies A to C Have the Same Shape)

- Reduction angle γ: 13 degrees (Opening angle: hereinafter, all reduction angles are indicated as opening angles)
- Length L of bearing 1*d*: 30% D
- Diameter D of die hole 1*h*: 0.18 mm (reduction of area is set to 16%)
- Surface roughness Ra within 40 μm in circumferential length of bearing 1*d*: 0.015 μm
- The surface roughness Ra of bearing 1*d* is measured as follows.

It is known that the surface roughness Ra of bearing 1*d* is determined by a tool for polishing bearing 1*d* and polishing conditions. First and second dies of the same material and size are prepared. The first and second dies are polished with the same polishing tool and polishing conditions. Thus, bearings 1*d* of the first and second dies have the same surface roughness Ra. Examples of the polishing method include ultrasonic polishing using a polishing needle and loose abrasive grains, and polishing by laser processing.

In order to observe the cross-sectional shape of die hole 1*h* of the first die, die 1 is ground from the lateral surface side by a surface grinder, and 50% or more of diameter D of the die hole is ground.

Figure 2:
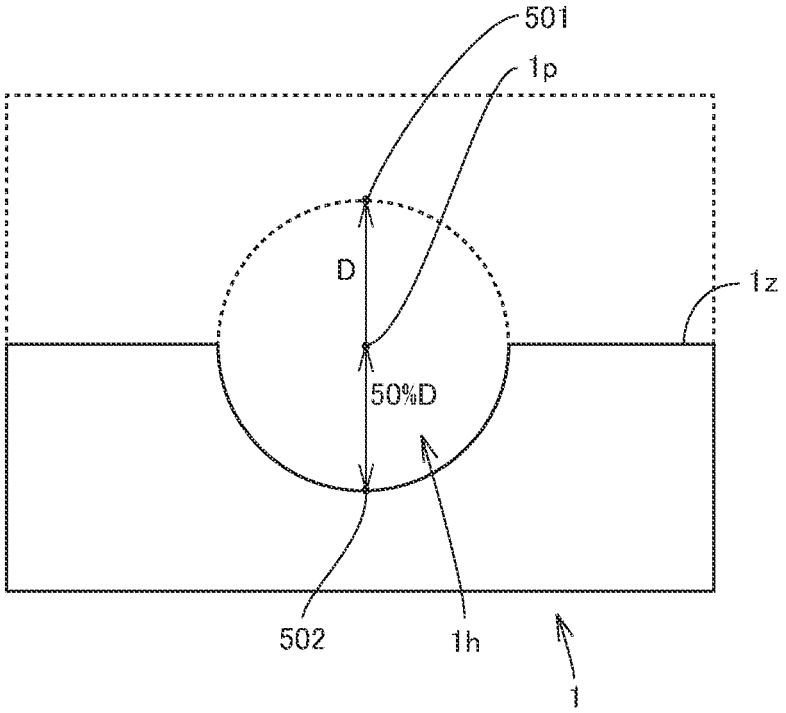
FIG. 2 is a cross-sectional diagram taken along line II-II in FIG. 1.

FIG. 2 is a cross-sectional diagram taken along line II-II in FIG. 1. In FIG. 2, the shape of the die before the die is ground is indicated by a dotted line. Die hole 1*h* is ground such that the distance from center line 1*p* to a point 501 is greater than or equal to 50% D. The distance from center line 1*p* to a point 502 is less than or equal to 50% D.

Exposed die hole 1*h* is degreased and cleaned with alcohol or the like to remove dirt on bearing 1*d*. The following apparatus is used for the measurement.

- Measuring apparatus: MEASURING LASER MICROSCOPE OLS4000 manufactured by Olympus Corporation
- Image size (pixels): 1024×1024
- Image size: 258×258 μm
- Scan mode: XYZ high definition+color
- Objective lens: MPLAPONLEXT×50
- DIC: OFF
- Zoom: ×1
- Evaluation length: 40 μm
- Cut-off λc: 8 μm
- Filter: Gaussian
- Analysis parameter: roughness parameter
- Magnification: ×100
- Cut-off: 8 μm Using the measuring apparatus described above, an image including a surface roughness measurement portion is captured under the imaging conditions described above. At this time, an image as bright as possible is acquired to the extent that the image is not reflected due to scratches or the like. When the image is captured, a ground surface 1*z* of the die is set so as to be parallel to the microscope.

Figure 3:
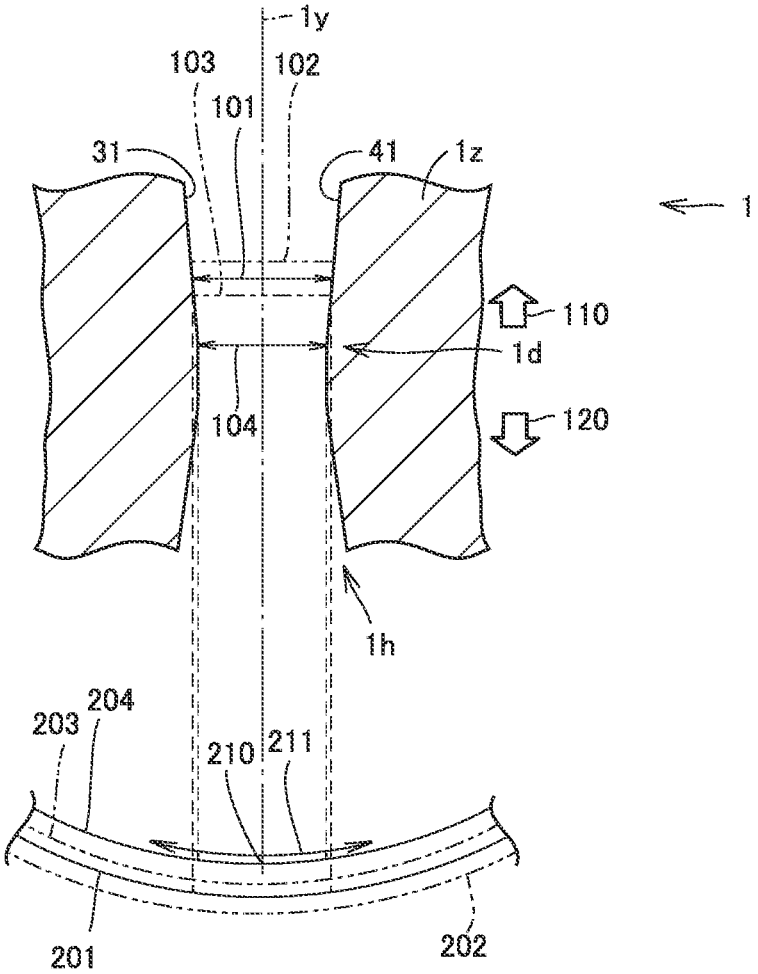
FIG. 3 is a diagram for describing a method for measuring surface roughness inside a bearing 1*d*.

FIG. 3 is a diagram for describing a method for measuring the surface roughness inside bearing 1*d*. The captured image is displayed on a screen, and a line 1*y* is drawn at a position equidistant from wall surfaces 31 and 41 at both ends of die hole 1*h* in FIG. 3. Line 1*y* substantially coincides with center line 1*p* of die hole 1*h*.

A line 101 in a direction perpendicular to line 1*y* is displayed. The shape of the inner peripheral surface of die hole 1*h* (a circle constituting a plane perpendicular to center line 1*p* and including line 101) at the position of line 101 is displayed as an arc line 201.

Line 101 is translated in the upward direction indicated by an arrow 110 to the position of line 102, for example. Accordingly, the shape of the inner peripheral surface of die hole 1*h* (a circle constituting a plane perpendicular to center line 1*p* and including line 102) at the position of line 102 is displayed as an arc line 202. The radius of arc line 202 is larger than the radius of arc line 201.

Line 101 is translated in the downward direction indicated by an arrow 120 to the position of line 103, for example. Accordingly, the shape of the inner peripheral surface of die hole 1*h* (a circle constituting a plane perpendicular to center line 1*p* and including line 103) at the position of line 103 is displayed as an arc line 203. The radius of arc line 203 is smaller than the radius of arc line 201. In this manner, line 101 is moved in the upward direction indicated by arrow 110 and the downward direction indicated by arrow 120 to display the inner peripheral surface at each position, and a position where the radius of the arc line is minimized, that is, a position where the arc line is the highest is obtained. The obtained position corresponds to bearing 1*d*.

An arc line 204 corresponding to a line 104 of bearing 1*d* indicates the shape of the inner peripheral surface of the bearing.

A region within 20 μm on each side (40 μm in total) with respect to a bottom portion (in FIG. 3, an intersection point 210 of line 104 and line 1*y*) of arc line 204 is set as a roughness measurement region, and the surface roughness Ra in this region is defined as the surface roughness of bearing 1*d*.

The first die and the second die had the same surface roughness Ra of bearing 1*d*, and the wire drawing process was performed using the second die.

Wire drawing conditions

Wire: SUS316L

Drawing speed: 500 m/min

Lubrication: Oil

Wire drawing distance: 30 km

The results are shown in Table 1.

TABLE 1

| Table 1 | Life | Ring-shaped wear | Amount of change in wire diameter (μm) | Uneven wear | Pulling force (15-30 km) | Surface roughness Ra of wire (μm) |
|---|---|---|---|---|---|---|
| Single-crystal diamond | 20 km | Large | 0.6 | Observed | No change | 0.106 |
| Binderless PCD | 30 km or more | Large | 0 | Not observed | 10% increase | 0.82 |
| CBN | 30 km or more | Small | Not observed | Not observed | No change | 0.86 |

In the determination of "life" in Table 1, it is determined that the die reached the end of its life when surface roughness Ra of the wire after wire drawing reached 0.100 μm or more.

The "ring-shaped wear" indicates that the vicinity of reduction 1*c* on the inner peripheral surface of the die wears annularly.

Figure 4:
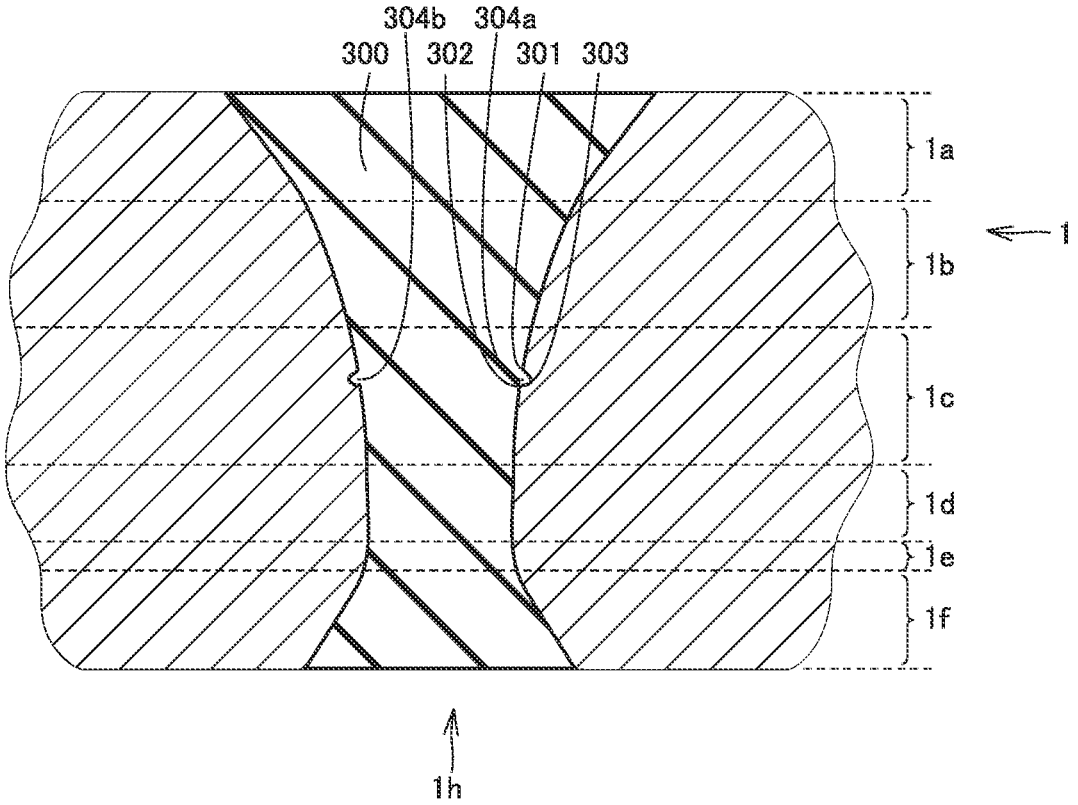
FIG. 4 is a cross-sectional diagram illustrating a die hole 1*h* and a replica 300 filled in the die hole 1*h*.

The degree of the ring-shaped wear was identified by the following method. Die hole 1*h* is filled with a transfer material (for example, a replica set manufactured by Struers, K.K.) to prepare a replica to which the shape of die hole 1*h* is transferred. This replica is cut along a plane including center line 1*p* to obtain a cross-sectional diagram of die hole 1*h* such as die hole 1*h* in FIG. 1. FIG. 4 is a cross-sectional diagram illustrating die hole 1*h* and a replica 300 filled in die hole 1*h*. As illustrated in FIG. 4, replica 300 has a shape along die hole 1*h*. The shape of the inner surface of die hole 1*h* is transferred to the outer surface of replica 300. Ring-shaped wear 304*a* and ring-shaped wear 304*b* are formed in reduction 1*c*. Replica 300 is imaged with a transmission microscope, the areas of ring-shaped wear 304*a* and 304*b* are calculated using image analysis software (WinRoof, ImageJ, etc.), and the larger area is used as a result of the ring-shaped wear. In FIG. 4, ring-shaped wear 304*a* and ring-shaped wear 304*b* are formed on the left and right of replica 300. The areas of ring-shaped wear 304*a* and ring-shaped wear 304*b* are calculated, and the larger area is used as the result. An area of a portion surrounded by a straight line connecting an upper end 301 and a lower end 302 of ring-shaped wear 304*a* and a ridgeline 303 was defined as an area of ring-shaped wear 304*a*. When the area was greater than or equal to 50 $\mu m^2$, the ring-shaped wear was determined to be larger. When the area was less than 10 $\mu m^2$, the ring-shaped wear was determined to be smaller. When the area was greater than or equal to 10 $\mu m^2$ and less than or equal to 50 $\mu m^2$, the ring-shaped wear was determined to be medium.

The "amount of change in wire diameter" indicates a difference between the wire diameter of the wire after wire drawing at the start of wire drawing and the wire diameter of the wire at an earlier time point out of the time point at which the die has reached the end of its life and the time point at which the wire has been drawn for 30 km.

The "uneven wear" means that bearing 1*d* is deformed into a shape other than a circular shape. Wear of single-crystal diamond varies depending on a plane orientation of the single-crystal diamond. Therefore, it is easy to wear in one direction and is difficult to wear in another direction. As a result, uneven wear occurs. The binderless PCD and the CBN are polycrystals, and thus, wear in the same manner in all directions. Therefore, uneven wear does not occur in the binderless PCD and the CBN.

The "pulling force" indicates an increase rate of the pulling force when the wire is drawn for 30 km to the pulling force when the wire is drawn for 15 km for the binderless PCD and the CBN. Regarding the single-crystal diamond, the "pulling force" indicates an increase rate of the pulling force when the wire is drawn for 20 km to the pulling force when the wire is drawn for 15 km.

The "surface roughness Ra of wire" indicates surface roughness Ra of the wire at an earlier time point out of the time point at which the die has reached the end of its life and the time point at which the wire has been drawn for 30 km. Ra is defined by JIS B 0601 (2001), and was measured by MEASURING LASER MICROSCOPE OLS4000 manufactured by Olympus Corporation.

When the wire was drawn for 20 km with the single-crystal diamond die, the surface roughness of the wire was deteriorated, and the single-crystal diamond die reached the end of its life. When the die after wire drawing was observed, uneven wear and ring-shaped wear were great, and irregularities were generated on the inner surface of the die. It is presumed that the irregularities were transferred to the wire, and thus the die reached the end of its life.

The binderless PCD die had ring-shaped wear when the wire was drawn for 15 km. When the wire was drawn for 30 km, the binderless PCD die had the deepest ring-shaped wear among the three types of dies. In addition, it has been confirmed that the pulling force has increased by about 10% due to the progress of ring-shaped wear, and it is presumed that disconnection is likely to occur.

The CBN die had obviously less ring-shaped wear than the other dies after the drawing of wire for 30 km. In addition, changes in wire diameter or pulling force were hardly observed. Thus, the CBN die had good wire-drawing performance.

EXAMPLE 2

(Basic Evaluation of Shape Dependence of Binderless CBN Die)

In order to compare the shape dependence due to a difference in die material, the following dies were prepared and evaluated. The specifications other than the wire drawing evaluation conditions and the reduction angle are the same as those in Example 1.

Die material

Three types of dies were prepared: A. single-crystal diamond die, B. binderless PCD die, and C. CBN die which are the same as those in Example 1. The CBN die contains 99 mass % or more CBN and less than 1 mass % of hBN. The crystal grain size D50 of CBN is 200 to 300 μm.

Die shape: (Dies A to C have the same shape)

Reduction angle: 18 degrees

Length of bearing 1*d:* 30% D

Surface roughness Ra within 40 μm in circumferential length of bearing 1*d:* 0.015 μm Diameter D of die hole 1*h:* 0.18 mm (reduction of area is set to 16%)

Wire drawing conditions

Wire: SUS316L

Drawing speed: 500 m/min

Lubrication: Oil

The results are shown in Table 2.

TABLE 2

| | Wire drawing distance | Ring-shaped wear | Amount of change in wire diameter (μm) | Surface roughness Ra of wire (μm) |
|---|---|---|---|---|
| Single-crystal diamond | 13 km | Medium | 0.2 | 0.106 |
| Binderless PCD | 13 km | Medium | 0.2 | 0.82 |
| CBN | 13 km | Not observed | 0.6 | 0.86 |

The CBN die reached the end of its life when the wire was drawn for 13 km, and thus, the evaluation was interrupted at that point. Unlike the case where the reduction angle was 13°, the CBN die had the shortest life.

It can be confirmed that ring-shaped wear occurred in the single-crystal diamond die and the binderless PCD die. On the other hand, the CBN die had no ring-shaped wear, but the inner surface was very rough from reduction 1*c* to bearing 1*d*, and an amount of change in wire diameter was also greater than that of other diamond dies. From this result, it can be seen that the CBN die has an effect of suppressing ring-shaped wear regardless of shapes, but when having a high angle by which a surface pressure is likely to increase, the CBN die cannot sufficiently exhibit performance, because the CBN has relatively lower hardness than diamond.

EXAMPLE 3

The performance of the CBN die when the reduction angle was changed was examined.

Wire drawing conditions

Size of die hole: 80 μm

Wire: SUS316L

Wire drawing distance: 60 km

Drawing speed: 500 m/min

Back tension: 5 cN

Die specification: see Table 3

Die material: CBN die only The CBN die contains 99 mass % or more CBN and less than 1 mass % of hBN. The crystal grain size D50 of CBN is 200 to 300 μm.

The same measurement as in Example 1 was performed. The results are shown in Table 3.

TABLE 3

| | | | | Result of wire drawing | | | | |
|---|---|---|---|---|---|---|---|---|
| Table 3 Die number | Reduction angle (°) | Bearing length (% D) | Surface roughness Ra of bearing (μm) | Amount of change in wire diameter (μm) | Surface roughness Ra of wire (μm) | Roundness (μm) | Life | Remarks |
| 1 | 11 | 30 | 0.010 | 0.1 | 0.038 | 0.1 | A | — |
| 2 | 13 | 30 | 0.010 | 0.2 | 0.041 | 0.2 | A | — |
| 3 | 15 | 30 | 0.010 | 0.1 | 0.040 | 0.1 | A | — |
| 4 | 17 | 30 | 0.010 | 0.3 | 0.045 | 0.2 | A | — |
| 5 | 18 | 30 | 0.010 | 0.5 | 0.060 | 0.2 | B | — |
| 6 | 19 | 30 | 0.010 | 0.8 | 0.086 | 0.4 | C | — |

The life was determined such that, with the life of the die of die number 4 being set as 1, the die having a life greater than or equal to 1 was evaluated as A, the die having a life greater than or equal to 0.8 and less than 1 was evaluated as B, and the die having a life less than 0.8 was evaluated as C.

The "surface roughness Ra of bearing" indicates surface roughness Ra within 40 μm in the circumferential length of bearing 1*d* as in Examples 1 and 2.

In the wire drawing results, 0.5 μm or less is acceptable for the amount of change in wire diameter, 0.05 μm or less is acceptable for surface roughness Ra of the wire, 0.3 μm or less is acceptable for the roundness, and A or B is acceptable for the life. Comprehensively, the die was determined to be good (acceptable) as a wire drawing die when it was acceptable for all of the four items.

In order to determine the wire drawing performance due to a difference in the shape of the CBN die, an experiment was conducted by changing the reduction angle, that is, using five different reduction angles. The result shows that, when the reduction angle was less than or equal to 17 degrees, ring-shaped wear hardly occurred, and the surface roughness of wire, the roundness, and the amount of change in wire diameter tended to decrease.

On the other hand, when the reduction angle exceeded 17 degrees, the progress of the ring-shaped wear and the wear of the bearing rapidly accelerated, and problems such as deterioration of the surface roughness of the wire and an increase in wire diameter occurred. From the above results, the appropriate reduction angle as the CBN die is recommended to be less than or equal to 17 degrees.

EXAMPLE 4

The performance of the CBN die when the bearing length was changed was examined.

CBN dies each having a bearing length shown in Table 4 were prepared, and a wire drawing test was performed under the same conditions as in Example 3. The results are shown in Table 4.

TABLE 4

| | | | | Result of wire drawing | | | | |
|---|---|---|---|---|---|---|---|---|
| Table 4 Die number | Reduction angle (°) | Bearing length (% D) | Surface roughness Ra of bearing (μm) | Amount of change in wire diameter (μm) | Surface roughness Ra of wire (μm) | Roundness (μm) | Life | Remarks |
| 7 | 13 | 10 | 0.010 | 0.2 | 0.046 | 0.2 | A | — |
| 2 | 13 | 30 | 0.010 | 0.2 | 0.041 | 0.2 | A | — |
| 8 | 13 | 50 | 0.010 | 0.2 | 0.043 | 0.1 | A | — |
| 9 | 13 | 100 | 0.010 | 0.1 | 0.045 | 0.2 | B | — |
| 10 | 13 | 200 | 0.010 | 0.2 | 0.047 | 0.2 | B | — |
| 11 | 13 | 400 | 0.010 | 0.1 | 0.050 | 0.3 | B | Disconnection occurred much |

The life was determined such that, with the life of the die of die number 4 being set as 1, the die having a life greater than or equal to 1 was evaluated as A, the die having a life greater than or equal to 0.8 and less than 1 was evaluated as B, and the die having a life less than 0.8 was evaluated as C.

Acceptance criteria were the same as those in Example 3.

When the bearing length was less than 400% D, ring-shaped wear hardly occurred even when wire drawing was performed, and the wire quality (change in wire diameter, roughness, and roundness) was also kept in good condition.

When the bearing length was 400% D, the wire quality was good, but disconnection and the like were likely to occur. However, when the drawing speed is lowered, good wire drawability (no disconnection) is obtained. From the above results, the CBN die exhibits the best performance when the bearing has a length less than or equal to 200% D.

EXAMPLE 5

The influence of initial surface roughness in die hole 1*h* of the CBN die on the wire drawing performance was examined. The performance of the CBN die when the bearing surface roughness was changed was examined.

CBN dies each having a bearing length shown in Table 5 were prepared, and a wire drawing test was performed under the same conditions as those in Example 3.

The results are shown in Table 5.

TABLE 5

| | | | | Result of wire drawing | | | | |
|---|---|---|---|---|---|---|---|---|
| Table 5 Die number | Reduction angle (°) | Bearing length (% D) | Surface roughness Ra of bearing (μm) | Amount of change in wire diameter (μm) | Surface roughness Ra of wire (μm) | Roundness (μm) | Life | Remarks |
| 2 | 13 | 30 | 0.010 | 0.2 | 0.041 | 0.2 | A | — |
| 12 | 13 | 30 | 0.025 | 0.2 | 0.049 | 0.1 | B | — |
| 13 | 13 | 30 | 0.050 | 0.1 | 0.082 | 0.3 | C | — |

The life was determined such that, with the life of the die of die number 4 being set as 1, the die having a life greater than or equal to 1 was evaluated as A, the die having a life greater than or equal to 0.8 and less than 1 was evaluated as B, and the die having a life less than 0.8 was evaluated as C. Acceptance criteria were the same as those in Example 3.

The initial roughness on the inner surface of the die does not greatly affect an amount of change in wire diameter and roundness during drawing. On the other hand, it has been found that initial roughness of the die greatly affects the quality of the wire. From the above, the surface roughness Ra of the inner surface of the die is desirably less than or equal to 0.025 μm.

The embodiment and examples disclosed herein are to be considered in all respects as illustrative and not restrictive. The scope of the present invention is defined not by the above embodiment but by the claims, and is intended to include meanings equivalent to the claims and all modifications within the scope.

REFERENCE SIGNS LIST

1: die, 1*a*: bell, 1*b*: approach, 1*c*: reduction, 1*d*: bearing, 1*e*: back relief, 1*f*: exit, 1*h*: die hole, 1*p*, 1*y*: center line, 101, 102, 103, 104: line, 1*z*: ground surface of die, 11*a*, 11*b*, 11*c*: reference point, 12*a*, 12*b*, 12*c*, 13*a*, 13*b*, 13*c*: tangent line, 31, 41: wall surface, 110, 120: arrow, 201, 202, 203, 204: arc line, 210: intersection point, 501, 502: point

The invention claimed is:

1. A wire drawing die comprising a non-diamond material having a die hole, a reduction, and a bearing positioned downstream of the reduction, wherein the non-diamond material includes CBN, and a reduction angle which is an opening angle of the die hole at the reduction is less than or equal to 17°, a length L of the bearing is less than or equal to 200% D, where D is a diameter of the bearing, and a surface roughness Ra of the die hole within ±20 μm from a specific position inside the bearing in a circumferential direction of the die hole that is perpendicular to a wire drawing direction is less than or equal to 0.025 μm.

2. The wire drawing die according to claim 1, wherein the die reduces an area of a wire by greater than or equal to 5%.

3. The wire drawing die according to claim 1, wherein the die is in initial contact with a wire on the reduction, and the die is in contact with the wire at a length greater than or equal to 50% D including the bearing, where D is the diameter of the bearing.

4. The wire drawing die according to claim 1, wherein the die has a thermal conductivity of 100 to 300 W/(m·K).

5. The wire drawing die according to claim 1, wherein the length L of the bearing is less than or equal to 50% D, where D is the diameter of the bearing.

6. The wire drawing die according to claim 1, wherein the wire drawing die contains 99 mass % or more CBN and less than 1 mass % of hBN.

7. The wire drawing die according to claim 1, wherein the crystal grain size D50 of CBN is 200 to 300 μm.

* * * * *